United States Patent [19]

Burke

[11] 3,994,697

[45] Nov. 30, 1976

[54] FUEL DISTRIBUTED SOLID LUBRICANT FOR INTERNAL COMBUSTION

[75] Inventor: Harry B. Burke, Evanston, Ill.

[73] Assignee: Moly Protech Corporation, Chicago, Ill.

[22] Filed: July 24, 1974

[21] Appl. No.: 491,333

[52] U.S. Cl. ..... 44/51; 44/58; 252/25; 252/26

[51] Int. Cl.[2] ..... C10L 1/30

[58] Field of Search ..... 44/51, 58; 252/12, 26, 252/11, 14, 25

[56] References Cited

UNITED STATES PATENTS

| | | | |
|---|---|---|---|
| 725,253 | 4/1903 | James | 252/26 |
| 1,269,000 | 6/1918 | Rice | 252/12 |
| 2,439,897 | 4/1948 | LaChapelle | 44/51 |
| 2,742,427 | 4/1956 | Reiff | 252/26 |
| 3,317,433 | 5/1967 | Eichel | 44/51 |
| 3,795,493 | 3/1974 | Mertl | 252/12 |

*Primary Examiner*—Daniel E. Wyman
*Assistant Examiner*—Harris-Smith Y.
*Attorney, Agent, or Firm*—Kegan, Kegan & Berkman

[57] ABSTRACT

A solid lubricant consisting of metals combined with a high lubricity salt fabricated in pellet form and introduced into the fuel reservoir of an internal combustion engine. The pellet slowly disintegrates to produce extremely minute solid particles which are dispersed in the fuel and delivered to the fuel-contacting engine parts of the engine to deposit a lubricant film thereon.

1 Claim, No Drawings

FUEL DISTRIBUTED SOLID LUBRICANT FOR INTERNAL COMBUSTION

BACKGROUND OF THE INVENTION

This invention relates to lubricants for internal combustion engines. More particularly, the invention is directed to a solid lubricant which is introduced into and is dispersible within the liquid fuel system of an internal combustion engine for delivery to fuel-contacting moving parts, to coat and to lubricate such parts. In a preferred embodiment of the invention, the pellet includes, in addition to a mixture of metal components, the salt molybdenum disulphide.

The prior art is replete with formulations of many types for the lubrication of engine components, including engine parts in internal combustion engines. Such lubricants have taken various physical forms including oils and greases as well as oil and grease compositions in which solids such as graphite have been dispersed or suspended. In addition, grease-like lubricating compositions which include the lubricant molybdenum disulphide are also known.

Coupled with a wide diversity in the compositions themselves, various different techniques have been invoked in distributing or applying the lubricant to the areas to be treated. Such techniques have conventionally included incorporation of the lubric material in the engine crank case. In other procedures gasoline-soluble liquid phase lubricants have been added directly to the fuel supply. In spite of extensive experimentation, developmental work and research carried out, no technique and no lubricating composition has proved completely satisfactory for the purposes intended. It is, therefore, the aim of the present invention to provide both a new type lubric composition and a new method of applying that composition to internal moving engine parts, particularly those parts associated with the combustion chamber of an internal combustion engine.

It is a principal object of the invention to provide, in a lubric composition, an improved physical form constituting a solid pellet which is introducible into for dispersion through the fuel so as to reach and lubricate those components of the internal combustion engine normally contacted by the fuel phase.

It is a related object of the invention to provide an improved lubric composition which is operative to deposit a highly effective lubricating film as a low-friction interface between moving parts of an internal combustion engine including such parts as cylinder walls and piston rings, valve stems and sleeves, and valve guides.

It is an important feature of the invention that the pellet lubricant is effectively dispersed in a fine particulate form and that the minute particles are, thereupon, delivered directly to lubrication requiring surfaces in an internal combustion engine to produce a highly-adherent pressure-resistant film of solid lubricant as a wear detering anti-friction coating.

Yet another object of the invention is to provide a fuel-carried composition which is effective to fill in and to smooth surface irregularities of moving metallic components of an internal combustion engine, which components have become worn, pitted, or eroded in use.

Still another object of the invention is to provide a solid pellet, disintegratable within the fuel system of an internal combustion engine, to provide a distribution of fine particulate metallic-like elements effective to produce a plating-like coating on the moving and wear-subjected surfaces of an internal combustion engine.

It is an important feature of the improved solid lubricant of the invention that it is impervious to the deleterious effects of high temperatures and pressures which ordinarily destroy or render liquid lubricants ineffective.

Still another important feature of the improved lubricant of the invention is that it is effective over an extended time period, the availability of the lubric particles being time sustained and being a function of the time-related "erosion" of the lubric pellet in the gasoline tank of the internal combustion engine.

It is a related object of the invention to provide a lubricant which is automatically and continuously dispersed and distributed as needed, without any attention being required from the vehicle operator or the servicing attendant.

Still another feature of the improved composition of the invention is that it is effective to establish a fluid-sealing coating on opposed sliding surface elements in an internal combustion engine, thereby to increase the compression values in the cylinders of such engines.

A related object of the invention is that the solid lubricant minimizes transport of lubricating oil from the crank case past the piston rings to the combustion chamber, thereby reducing significantly air pollution associated with the undesirable combustion and exhaust discharge of oil and oil breakdown products.

SUMMARY OF THE INVENTION

The novelty of the solid lubricant of the present invention lies not only in its form and its composition, but also in the manner in which the lubricant is distributed to the areas where it is to function. More specifically, the invention, in its preferred embodiment, constitutes a pill or pellet consisting of an intimate mixture or alloy of various metals in conjunction with a solid lubricant constituting a metallic salt, molybdenum disulfide being preferred. The physical pellet itself is, for example, prepared from a mixture of finely divided metal components plus the lubricant salt, all molded together to form an integral unitary mass. The resulting pellet, which is conveniently about 10 grams in weight, is introduced into the fuel tank where it undergoes physical abrasion by means of contacting the pellet with internal wall faces of the fuel tank through engine vibration or otherwise disintegrates over an extended period of time to disperse throughout the fuel system as finely divided particulate matter which is most effective as a surface-bonding plating and as a solid lubricant. The lubricant is not adversely affected by either high temperatures or high pressures and, in this sense, is highly superior to the more conventional oil or grease-like compositions.

The above and other objects, features, and advantages of the invention may be more clearly understood upon a review of the detailed description of the preferred embodiments. Such embodiments are presented here only as examples and are not to be considered as limiting the invention in any way.

DESCRIPTION OF THE PREFERRED EMBODIMENT

In accordance with a preferred embodiment of the invention, the aims and objects are accomplished by providing a molded pellet of solid lubric material, the pellet being formulated so as to be susceptible to abrasion within the fuel tank of a vehicle whereby the pellet undergoes a disintegration process to produce extremely fine particulate matter which is then distributed by the fuel to the combustion zone within the internal combustion engine. The lubric particles coat abutting moving surfaces with a fine lubricating or friction-reducing film while at the same time filling in and smoothing declivities, pittings and corroded areas in these surfaces. The overall effect is to cure or to ameliorate surface defects while simultaneously ensuring a high degree of interface lubricity thereby to minimize surface-to-surface friction and wear.

A specific composition which has been found to be particularly effective as a solid lubricant in an internal combustion engine in its critical cylinder and valve areas is the following, the relative proportions being in parts by weight.

EXAMPLE I

| | |
|---|---|
| tin | 64 |
| lead | 30 |
| bismuth | 2.5 |
| copper | 1.0 |
| antimony | 0.8 |
| zinc | 0.7 |
| molybdenum disulfide | 0.2 |

While the above formulation is preferred, the components are not critically restricted to the precise percentages or ratios indicated. For example, the amount of molybdenum disulfide may vary within the range of about 0.01 to about 10% by weight. The molybdenum disulfide itself is preferrably highly purified and of a colloidal nature thereby to ensure that no abrasive or other type of objectionable impurity is present which could impair the antifriction properties of the final preparation.

Each of the components set forth in Example I above may be varied within significant limits without appreciably or adversely affecting the overall effectiveness of the invention. The acceptable quantitative ranges for each component are indicated below in Example II, the numerical values designating parts by weight.

EXAMPLE II

| | |
|---|---|
| tin | 50–75 |
| lead | 25–50 |
| bismuth | 1–5 |
| copper | 0.5–2 |
| antimony | 0.1–1.5 |
| zinc | 0.1–1.5 |
| molybdenum disulfide | 0.1–10 |

As substitutes for, or to be used in conjunction with the molybdenum disulfide solid lubricant, other materials may be utilized. These include the disulfides, selenides and and tellurides of molybdenum, tungsten, and titanium, either individually of in combination. Each of these materials has been found effective to deposit on the cylinder walls, piston rings, valve stems and valve guide surfaces an adherent lubricant film-like coating guaranteeing an extremely low friction coefficient between moving contacting parts.

An important advantage achieved through the use of the present invention is a functionally significant increase in the cylinder compression readings. Typical improvement of the type realized is indicated in the data set forth below. In an eight cylinder internal combustion engine, the compression values for each cylinder prior to use of the composition of the invention was 130-135-135-140-135-135-135-135. These compression values increased to the following readings upon use of the solid lubricant of the invention 140-135-140-140-140-135-135-140. While at first view the changes might appear not to be significant, it must be appreciated that the compression increase was simultaneously accompanied by improved lubrication and lower coefficients of friction between the moving parts, all contributing to improved engine operation, extended useful engine life, and increased mileage.

In preparing the solid lubricant of the invention the various metals are combined in particulate form and the solid lubricant incorporated and distributed uniformly therethrough. The homogeneous mixture is then molded as in a fusion casting process and the resulting pellets are discharged as discrete units weighing about 10 grams each. It has been found that, in normal use, the addition of one of these pellets to the fuel system by introduction into the fuel tank at intervals of about 12,000 miles of driving is effective to accomplish the purposes of the invention. No detrimental or objectionable effects will result, however, through more frequent use of the pellets. When used in accordance with the teachings of the invention, the solid lubricant obviates the adverse effects produced by excessive friction, and minimizes wear of engine parts.

While disclosure of preferred embodiments of the lubricant and of preferred methods for formulating and producing the pellet lubricant of the invention have been provided, it will be apparent that numerous modifications and variations thereof may be made without departing from the underlying principles of the invention. It is, therefore, desired by the following claims to include within the scope of the invention all such variations and modifications by which substantially the results of this invention may be obtained through the use of substantially the same or equivalent means.

What is claimed is:

1. The method of applying a high lubricity film as a friction-reducing surface coating on those parts of an internal combustion engine which are exposed to and come into contact with engine fuel, said method comprising the steps of:

mixing at least about 0.1% by weight of solid lubricant selected from the group consisting of the sulfides, selenides and tellurides of molybdenum, tungsten and titanium, and mixtures thereof with finely divided powdered metals including tin and lead totalling about 95% by weight and about 5% by weight of a mixture of powdered bismuth, copper, antimony, and zinc, to provide a substantially homogeneous mixture, fusing and molding aliquots of said mixture to provide discrete pill-like pellets weighing about 10 grams each, introducing one of said pellets into a liquid fuel reservoir in the fuel supply system of an engine by depositing the pill in the fuel tank of the engine, slowly frictionally disintegrating the pellet by abrasively contacting the pellet with internal wall faces of the fuel tank through engine vibration to provide a fine, particulate dispersion of minute, pellet-derived lubric particles in the fuel contained in the fuel tank, distributing said dispersion with said fuel to fuel-contacting parts of the engine to coat abutting moving surfaces thereof as a lubricant therefor.

* * * * *